US007189095B1

(12) United States Patent
Tseng

(10) Patent No.: US 7,189,095 B1
(45) Date of Patent: Mar. 13, 2007

(54) LAMP SOCKET FOR TWO DIFFERENT TYPES OF LAMPS

(76) Inventor: Ming-chi Tseng, No. 18, Jhensing E. St., Wufong Township, Taichung County (TW)

( * ) Notice: Subject to any disclaimer, the term of this patent is extended or adjusted under 35 U.S.C. 154(b) by 0 days.

(21) Appl. No.: 11/439,287

(22) Filed: May 24, 2006

(51) Int. Cl.
*H01R 4/50* (2006.01)
*H01R 13/625* (2006.01)

(52) U.S. Cl. ..... 439/337

(58) Field of Classification Search ..... 439/337, 439/240, 241, 236, 673, 674
See application file for complete search history.

(56) References Cited

U.S. PATENT DOCUMENTS

| | | | | | |
|---|---|---|---|---|---|
| 580,320 | A * | 4/1897 | Jones | 337/200 |
| 2,259,096 | A * | 10/1941 | Alden | 439/137 |
| 2,290,701 | A * | 7/1942 | Mueller | 439/337 |
| 2,292,052 | A * | 8/1942 | Chirelstein | 439/337 |
| 2,319,693 | A * | 5/1943 | Kulka | 439/241 |
| 2,356,601 | A * | 8/1944 | MacCarthy | 439/236 |
| 2,372,051 | A * | 3/1945 | Beal | 439/337 |
| 2,380,211 | A * | 7/1945 | Biller | 439/241 |
| 2,571,881 | A * | 10/1951 | Howard | 439/337 |
| 3,955,872 | A * | 5/1976 | Brudy | 439/384 |
| 5,542,857 | A * | 8/1996 | Hume et al. | 439/337 |
| 6,254,252 | B1 * | 7/2001 | Coushaine et al. | 362/549 |
| 2003/0139078 | A1 * | 7/2003 | Ruthenberg | 439/236 |

* cited by examiner

*Primary Examiner*—Tulsidas C. Patel
*Assistant Examiner*—Vladimir Imas
(74) *Attorney, Agent, or Firm*—Rosenberg, Klein & Lee

(57) ABSTRACT

A lamp socket includes a socket having a bottom from which an outer wall and an inner wall extend. A base is engaged with the space defined by the inner wall and two first wires are connected with the base. Two flexible contact pieces each have a first end fixed to an inner periphery of the outer wall and a second end of each contact piece has a curved portion. Two second wires are connected between the two first ends of the two contact pieces and the two first wires. A cover is engaged with the socket and has a circular hole communicating with the base, and two slots which are located corresponding to the two contact pieces. A first type of lamp is connected to the base and a second type of lamp is connected with the two contact pieces via the two slots.

7 Claims, 6 Drawing Sheets

LAMP SOCKET FOR TWO DIFFERENT TYPES OF LAMPS

FIELD OF THE INVENTION

The present invention relates to a lamp socket which is able to be connected with two different types of lamps.

BACKGROUND OF THE INVENTION

A conventional lamp socket 71 is shown in FIG. 6 and generally includes a threaded inner periphery which is connected with a base 721 of a lamp 72, a contact tip is connected to a distal end of the base 721 so as to be electrically connected with the power source located in the socket 71. The other type of conventional lamp socket 73 is shown in FIG. 7 and includes two slots 731 defined therein and terminals are located in the slots 731. The lamp 74 has a board and two contact terminals 741 extend from the board. The contact terminals 741 are inserted into the slots 731 and contact the terminals to provide electric power to the lamp 74. The two different types of sockets 71, 73 are two individual sockets and the lamps 72, 74 have to be the right type. In other words, the users have to buy the two different types of lamps 72, 74 for replacement to the two different sockets 71, 73.

The present invention intends to provide a lamp socket that combines the two different types of sockets as one so that the user can install either one of the two types of lamps to the socket.

SUMMARY OF THE INVENTION

The present invention relates to a lamp socket that comprises a socket having a bottom, an outer wall and an inner wall extend from the bottom. A first space is defined between the outer and inner walls, and a second space is defined by the inner wall. Two positioning devices are connected to an inner periphery of the outer wall and located diametrically opposite to each other. Two first slots are defined through the bottom and located corresponding to the two positioning devices. A through hole is defined through the bottom and communicates with the second space. A base is received in the second space and has a first contact point located corresponding to the through holes, and a second contact point located at an inner periphery of the inner wall. Two flexible contact pieces are located in the first space and each have a first end and a second end. The first end of each contact piece is fixed by the positioning device corresponding thereto and each second end of each contact piece has a curved portion. The first and second contact points are electrically connected with the two contact pieces respectively. A cover is engaged with the socket and has a circular hole and two second slots defined therethrough. The circular hole is located corresponding to the base in the second space, and the two second slots are located corresponding to the two contact pieces.

The primary object of the present invention is to provide a lamp socket which includes two bases so that two different types of lamps can be cooperated with the socket respectively.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
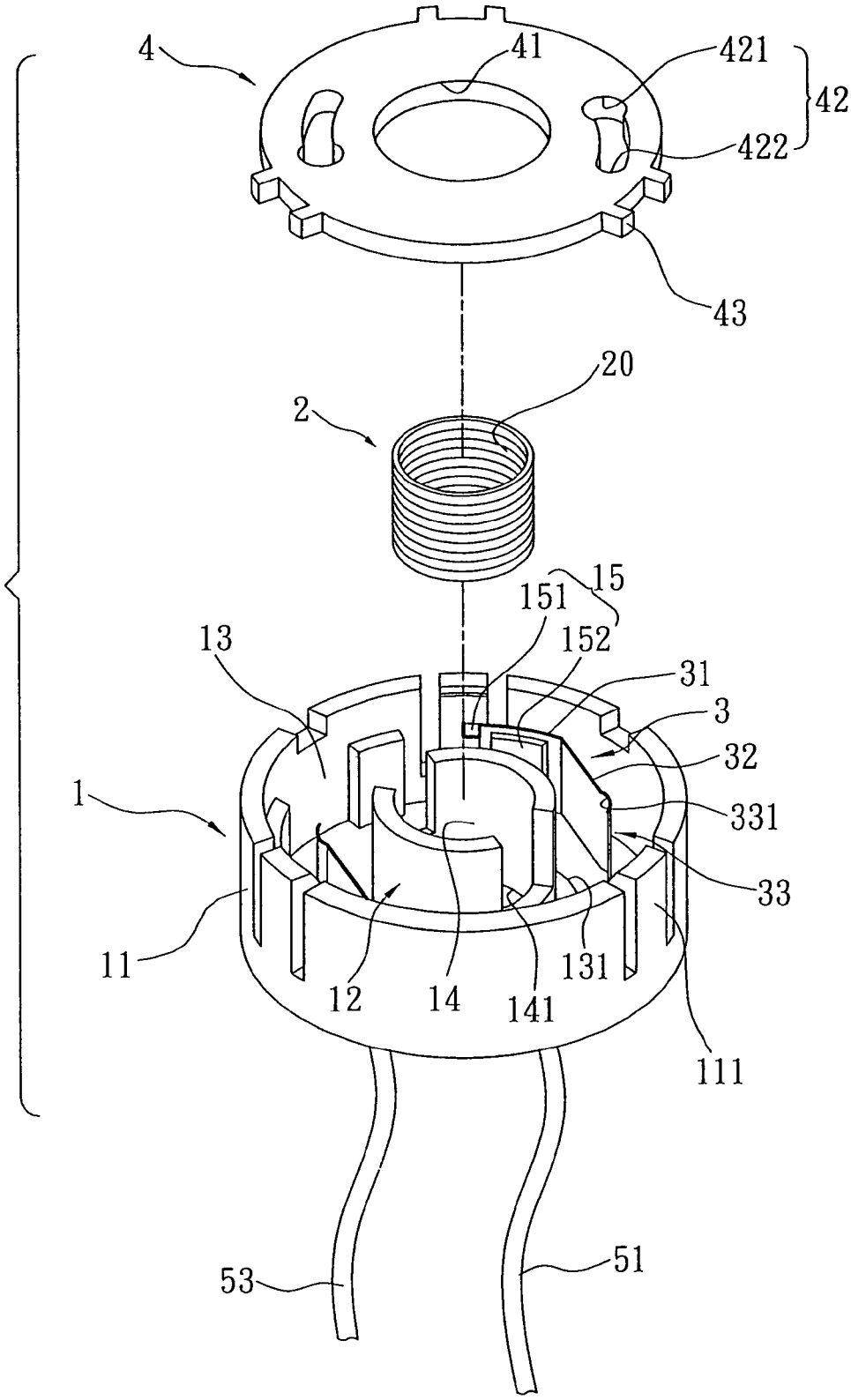
FIG. 1 is an exploded view to show the lamp socket of the present invention.
Figure 2:
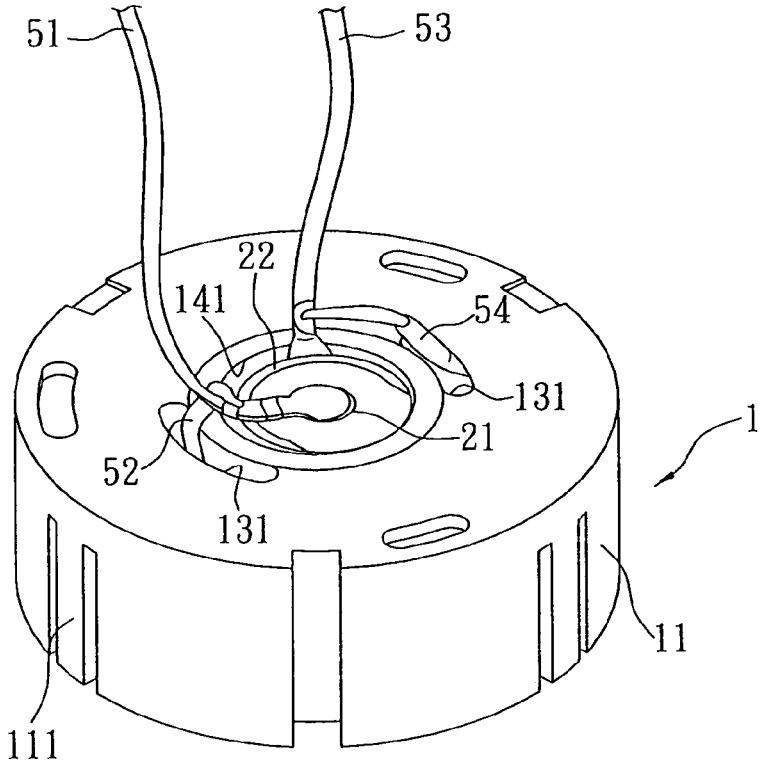
FIG. 2 is a perspective view to show the underside of the lamp socket of the present invention.
Figure 3:
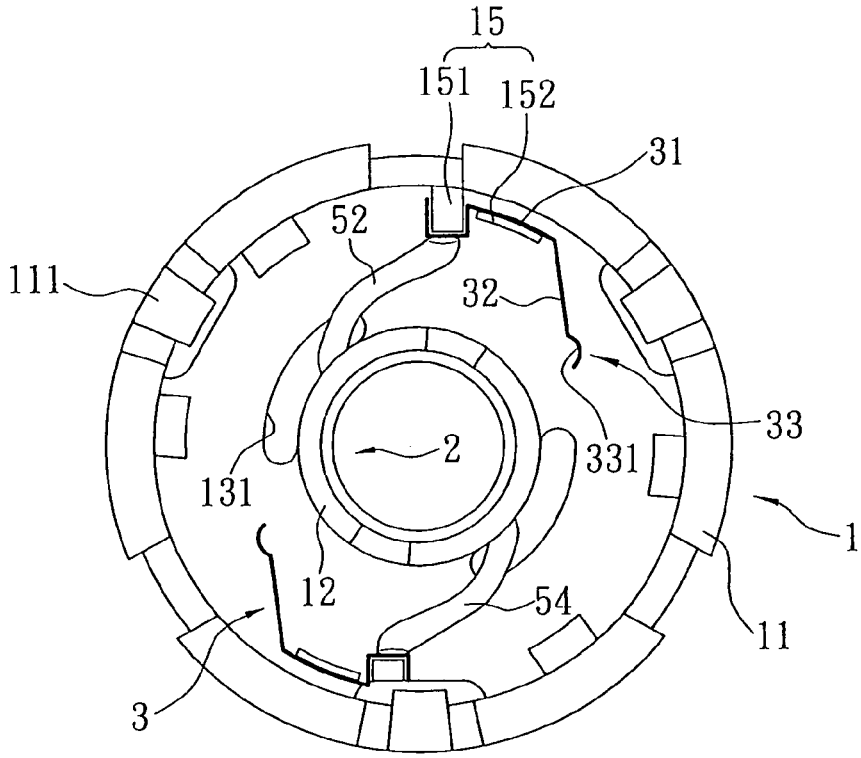
FIG. 3 is a top view to show the lamp socket of the present invention.

Referring to FIGS. 1 to 3, the lamp socket of the present invention comprises a socket 1 which has a bottom and an outer wall 11 and an inner wall 12 extend from the other side of the bottom. A first space 13 is defined between the outer and inner walls 11, 12, and a second space 14 is defined by the inner wall 12. The outer wall 11 has a plurality of connection pieces 111 and each connection piece 111 is located between two recesses defined in the outer wall 11. Two positioning devices 15 are connected to an inner periphery of the outer wall 11 and located diametrically opposite to each other. Each of the positioning devices 15 includes a protrusion 151 extending inward from the inner periphery of the outer wall 11, and a plate 152 extends from the other side of the bottom and has a gap between the plate 152 and the inner periphery of the outer wall 11.

Two first slots 131 are defined through the bottom and located corresponding to the two positioning devices 15. A through hole 141 is defined through the bottom and communicates with the second space 14.

A base 2 is received in the second space 14 and has a threaded inner periphery 20. A first contact point 21 and a second contact point 22 are connected with the base 2. The first contact point 21 is located corresponding to the through holes 141 and the second contact point 22 is located at an inner periphery of the inner wall 12.

Two flexible contact pieces 3 which are two copper plates and located in the first space 13. Each contact piece 3 has a first end 31 and a second end 32, the first end of each contact piece 3 is mounted to the protrusion 151 and located between the plate 152 and the outer wall 11. Each second end of each contact piece 3 has a curved portion 33 and each of the curved portions 33 has a concavity 331 facing the inner wall 12. The first and second contact points 21, 22 are electrically connected with the two contact pieces 3 respectively.

The first contact point 21 and the contact piece 3 are connected with each other by a first wire 51 and a second wire 52. The first wire 51 has one end connected with the first contact point 21 and the second wire 52 has one end connected to the first end of the contact piece 3 via one of the first slots 131. The other end of the second wire 52 is connected to the first wire 51. The second contact point 22 and the contact piece 3 are connected with each other by a third wire 53 and a fourth wire 54. The third wire 53 has one end connected with the second contact point 22 and the fourth wire 54 has one end connected to the first end 31 of the contact piece 3 via the other one of the first slots 131. The other end of the fourth wire 54 is connected to the third wire 53.

A cover 4 is engaged with the open top of the socket 1 and in contact with the contact pieces 3. A circular hole 41 and two second slots 42 are defined through the cover 4. The circular hole 41 is located corresponding to the base 2 in the second space 14, and the two second slots 42 are located corresponding to the two contact pieces 3. The cover 4 has a plurality of projections 43 which are engaged with the recesses defining the connection pieces 111 so that the cover 4 is secured to the socket 1. Each of the two second slots 42 includes a large width portion 421 and a small width portion 422 which is located corresponding to the curved portion 33 of the contact piece 3 corresponding thereto.

Figure 4:
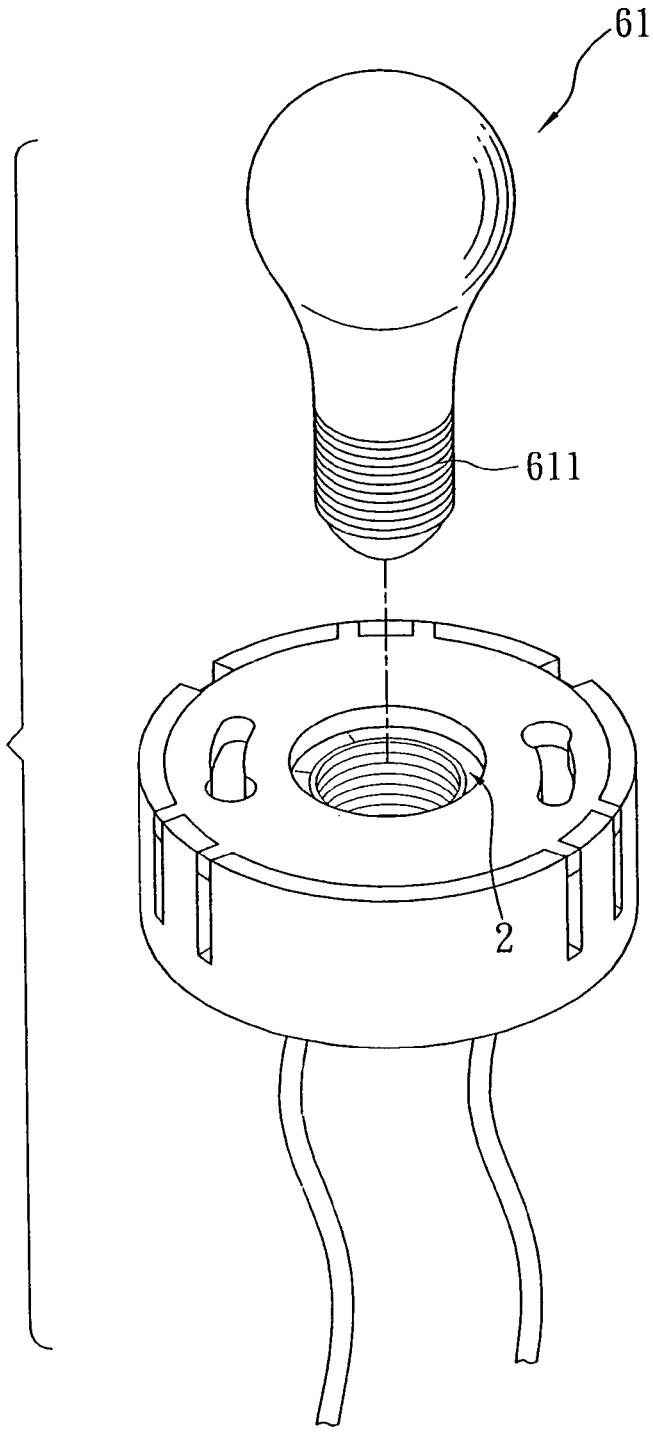
FIG. 4 shows that a first type of lamp is to be connected with the socket of the present invention.

As shown in FIG. 4, a first type of lamp 61 includes a threaded base portion 611 which can be threadedly connected with the threaded inner periphery 20 of the base 2. Therefore, the socket 1 can be used with the first type of lamp 61.

Figure 5:
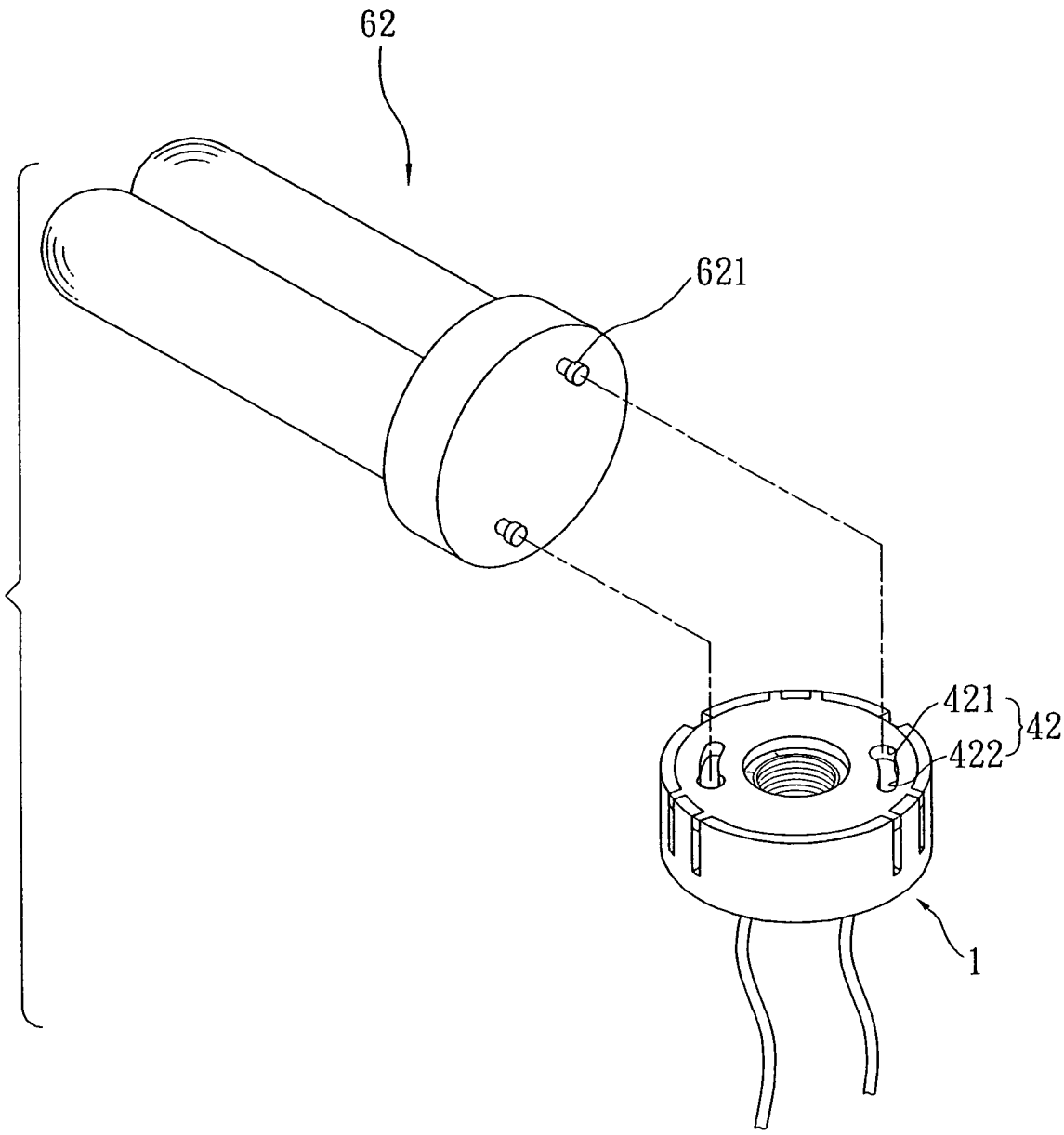
FIG. 5 shows that a second type of lamp is to be connected with the socket of the present invention.
Figure 6:
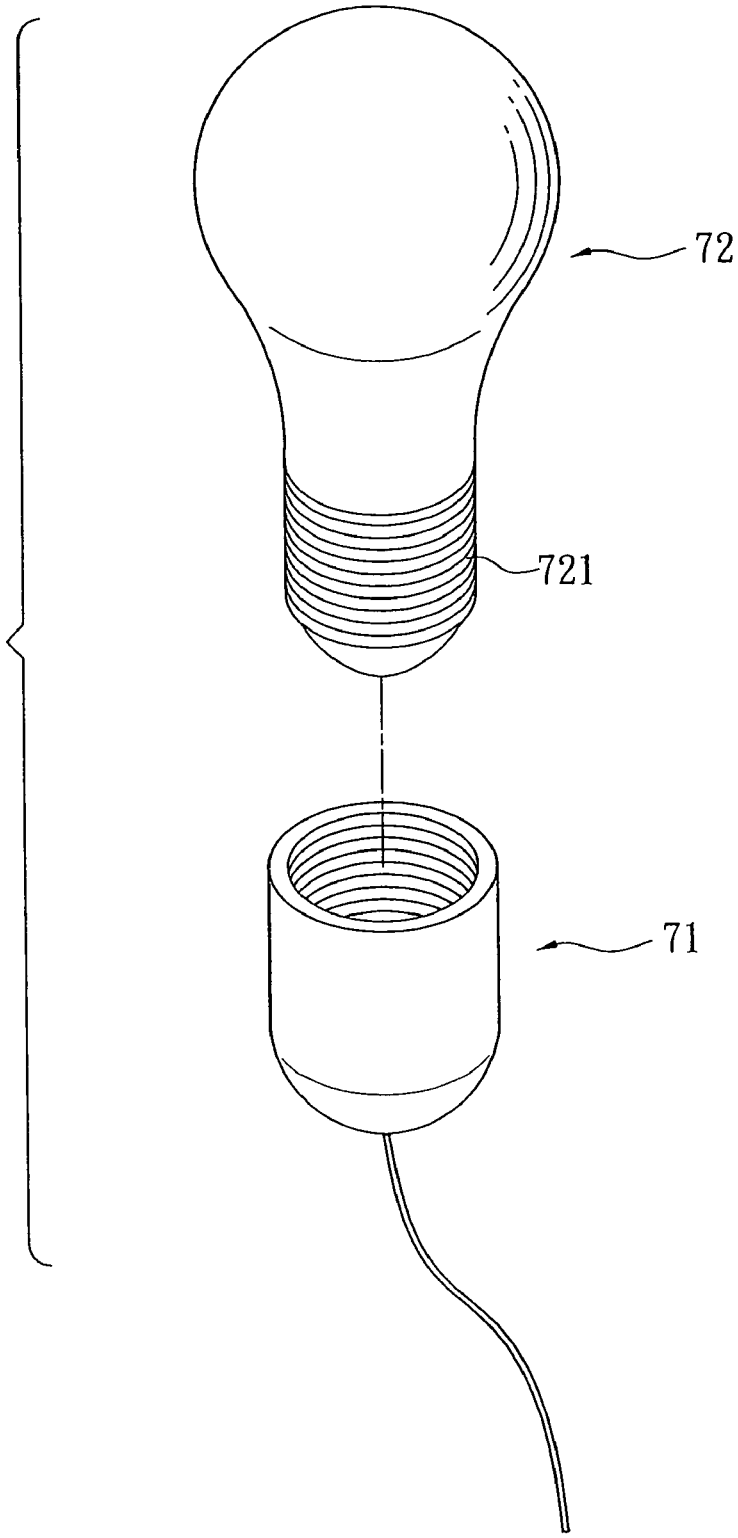
FIG. 6 PRIOR ART
FIG. 6 shows a first type of lamp and the first type of conventional socket.
Figure 7:
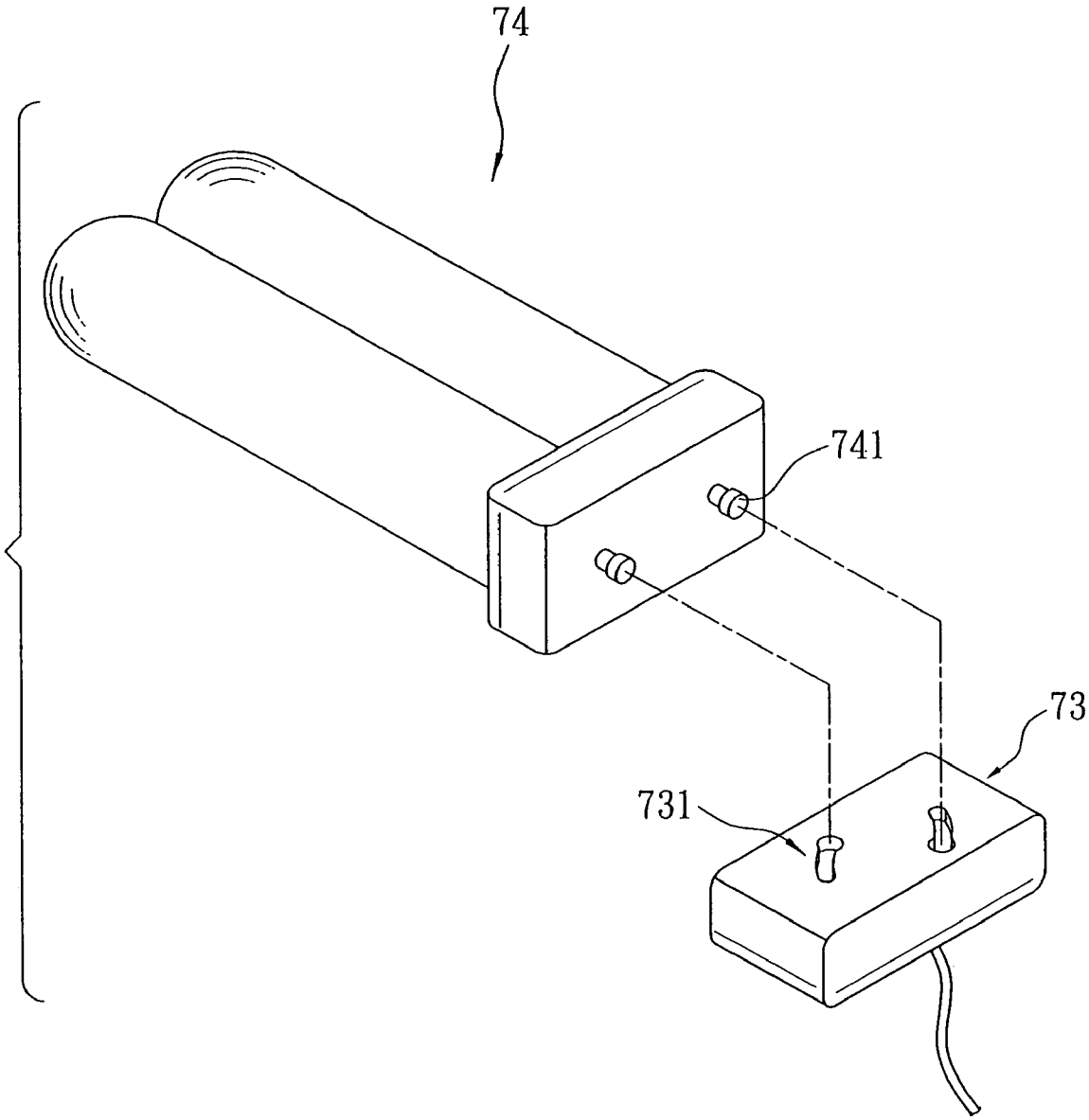
FIG. 7 PRIOR ART
FIG. 7 shows a second type of lamp and the second type of conventional socket.

As shown in FIG. 5, a second type of lamp 62 which has two terminals 621 on the base portion thereof and the two terminals 621 can be inserted into the large width portion 421 and then rotated along the small width portion 422 so as to push the second ends 32 of the contact pieces 3 and to be engaged with the concavities 331 of the curved portions 33. Therefore, the socket 1 of the present invention can be cooperated with the two different types of lamps 61, 62.

While we have shown and described the embodiment in accordance with the present invention, it should be clear to those skilled in the art that further embodiments may be made without departing from the scope of the present invention.

What is claimed is:

1. A lamp socket comprising:

a socket having a bottom and an outer wall and an inner wall extending from the bottom, a first space defined between the outer and inner walls, a second space defined by the inner wall, two positioning devices connected to an inner periphery of the outer wall and located diametrically opposite to each other, two first slots defined through the bottom and located corresponding to the two positioning devices, a through hole defined through the bottom and communicating with the second space;

a base received in the second space and having a first contact point and a second contact point, the first contact point located corresponding to the through holes and the second contact point located at an inner periphery of the inner wall;

two flexible contact pieces located in the first space and each having a first end and a second end, the first end of each contact piece being fixed by the positioning device corresponding thereto and each second end of each contact piece having a curved portion, the first and second contact points being electrically connected with the two contact pieces respectively, and a cover engaged with the socket and having a circular hole and two second slots defined therethrough, the circular hole is located corresponding to the base in the second space, the two second slots located corresponding to the two contact pieces.

2. The socket as claimed in claim 1, wherein the first contact point and the contact piece are connected with each other by a first wire and a second wire, the first wire has one end connected with the first contact point and the second wire has one end connected to the first end of the contact piece via one of the first slots, the other end of the second wire is connected to the first wire, the second contact point and the contact piece are connected with each other by a third wire and a fourth wire, the third wire has one end connected with the second contact point and the fourth wire has one end connected to the first end of the contact piece via the other one of the first slots, the other end of the fourth wire is connected to the third wire.

3. The socket as claimed in claim 1, wherein each of the positioning devices includes a protrusion and a plate, the first end of each of the contact pieces is mounted to the protrusion and located between the plate and the outer wall, the cover is engaged with the socket and in contact with the contact pieces.

4. The socket as claimed in claim 1, wherein each of the two second slots includes a large width portion and a small width portion which is located corresponding to the curved portion of the contact piece corresponding thereto.

5. The socket as claimed in claim 1, wherein each of the curved portions has a concavity facing the inner wall.

6. The socket as claimed in claim 1, wherein the outer wall has a plurality of connection pieces and the cover has a plurality of projections which are engaged with the connection pieces.

7. The socket as claimed in claim 1, wherein the contact pieces are two copper plates.

* * * * *